United States Patent [19]

Gasparaitis et al.

[11] 4,038,505

[45] July 26, 1977

[54] SUBMINIATURE CONNECTOR ARRANGEMENT

[75] Inventors: Bernard Gasparaitis, Fort Lauderdale; Jay H. Eichler, Boca Raton; Alfred Y. Terao, Margate, all of Fla.

[73] Assignee: Motorola, Inc., Schaumburg, Ill.

[21] Appl. No.: 554,829

[22] Filed: Mar. 3, 1975

[51] Int. Cl.[2] ..... H01R 13/70

[52] U.S. Cl. ..... 200/51.1; 339/45 M

[58] Field of Search ..... 200/51.09, 51.1; 339/176 M, 176 MP, 45 M

[56] References Cited

U.S. PATENT DOCUMENTS

| | | | |
|---|---|---|---|
| 2,899,669 | 8/1959 | Johanson | 339/176 M |
| 3,090,948 | 5/1963 | Cremer | 200/51.09 |
| 3,656,183 | 4/1972 | Walterscheid | 339/175 MP |

FOREIGN PATENT DOCUMENTS

| | | | |
|---|---|---|---|
| 795,132 | 3/1936 | France | 200/51.09 |
| 1,119,671 | 4/1956 | France | 200/51.09 |
| 1,343,143 | 10/1963 | France | 200/51.09 |

*Primary Examiner*—David Smith, Jr.
*Attorney, Agent, or Firm*—Donald B. Southard; James W. Gillman

[57] ABSTRACT

An improved subminiature electrical connector arrangement especially suited for miniature electrical or electronic apparatus. The connector arrangement includes a two-piece female connector assembly wherein one part thereof may be suitably interconnected to the circuitry of the apparatus while the same is outside the associated housing. This connector may then be placed in alignment with an opening within the housing and a second connector portion inserts within the opening and makes a snap-fit, weather tight seal therein and engages said first connector portion, all without special tools or any additional hardware. An associated male connector plug makes a convenient interconnection with the female assembly by including a hook-like projection overhanging one edge thereof and which engages a recess in the top of a housing to permit the male plug to rotate downwardly and inwardly into correct mechanical and electrical engagement with the female connector assembly. The male plug further includes a plurality of contact spring elements with sidewardly extending projections which make wiping engagement with associated contact members in the female connector assembly and which exert a sidewise force therein so that, upon release of the associated fastening means securing the plug to the housing in its interconnected position, the sidewise spring bias forces the male plug at least partially out of the female assembly for an automatic disengagement and eject facility.

8 Claims, 9 Drawing Figures

SUBMINIATURE CONNECTOR ARRANGEMENT

BACKGROUND OF THE INVENTION

The present invention relates in general to electrical connector assemblies and more particularly to an improved subminiature electrical connector arrangement especially suited for effecting appropriate interconnection between portable hand-held two-way communication equipment and associated remote control apparatus, such as a remote microphone-loudspeaker or a vehicular converter apparatus.

Miniaturized electronic apparatus, such as portable hand-held two-way communication equipment, is intended to be completely self-contained. That is, the radio circuit components are customarily powered by a self-contained power supply in the form of a plurality of dry cell or nickel-cadmium batteries. A speaker located behind a front grille structure may serve as both loudspeaker for listening purposes as well as a microphone for transmission of messages. In other applications, a separate microphone unit is utilized. In any event, suitable hand operated controls are included, such as on/-off, volume, squelch, frequency selection and the like, while an antenna, usually of the telescopic rod type, is conventionally included as well.

There are instances, however, when it is desired to effect some or all of the necessary control functions from a remote location, or at least from a position outside and separate from the radio housing itself. For example, it is often preferred to utilize a remote microphone/speaker unit clipped to the clothing of a user at some location near the ear, i.e., shoulder or coat lapel, which is then connected to wire lead or coaxial cable to the radio apparatus proper worn on the belt of the user. The remote unit also customarily includes an antenna extending upwardly, which to a large extent, avoids the body capacity effects that would otherwise obtain when the antenna on the radio apparatus extends from the unit at the user's belt level.

Still another remote connection requirement occurs when the hand-held portable equipment is to be utilized in a mobile converter installation in a way that the vehicular power source, i.e. 12-volt lead storage battery, and outside antenna apparatus is to be utilized, along with separate radio controls.

In either application, a remote connector device must be physically attached to the radio communication equipment in order to effect a plurality of necessary control functions. For example, the speaker unit within the radio unit must be disconnected, or at least inactivated, while the speaker unit in the remote control apparatus is to be connected instead. The remotely located antenna is connected in while the antenna included on the radio unit itself is disconnected. In vehicular conversion systems, the internal self-contained power source is disconnected and the vehicular battery source substituted in its place.

While connector arrangements to effect the foregoing purposes are of course known in the art, such prior art structures nevertheless leave a good deal to be desired and do not accomplish the task efficiently and reliably. Moreover, component parts of such prior connector assemblies are frequently damaged by being forced into and out of operative engagement because of misalignment and other mishandling.

SUMMARY OF THE INVENTION

Accordingly, it is an object of the present invention to provide an improved connector assembly for miniaturized electrical or electronic apparatus which overcomes the foregoing deficiencies.

A more particular object of the present invention is to provide an improved subminiature connector arrangement especially suited for use with hand-held portable two-way communication equipment where electrical interconnection is to be effected for remote control applications.

Another object of the present invention is to provide an improved subminiature connector arrangement of the foregoing type having a female portion integral with miniaturized electrical or electronic apparatus and a separate male portion which locates and cams from a reference point on the associated apparatus housing so as to provide accurate and automatic alignment at all times when interconnecting to the associated female connector portion.

Yet another object of the present invention is to provide an improved subminiature electrical connector arrangement of the foregoing type wherein the female portion thereof is in a two-piece configuration, one of which makes a snap-in, water tight fit within an appropriate opening in the electrical apparatus without the need of soldering or like operation.

Still another object of the present invention is to provide an improved subminiature electrical connector arrangement of the foregoing type wherein a male portion includes a plurality of spring biased resilient wiper arms which make wiping engagement with associated contact elements in the interior of a female portion.

A further object of the present invention is to provide an improved subminiature electrical connector arrangement of the foregoing type wherein the angle of wiping surface and spring bias of the wiper arms provides an automatic disconnect and ejection of the male connector portion from the female portion upon associated latching means being released.

The invention in its broader aspects contemplates an improved electrical connector assembly or arrangement suitable for use with miniaturized electrical or electronic apparatus, such as portable, self-contained, hand-held two-way communications equipment. Such connector arrangement is necessary for effecting the appropriate interconnection between the radio and remote control apparatus in the event it is desired to operate the radio at some remote location or at least a location separate and apart from the radio proper.

The connector arrangement in the preferred form consists of a two-piece female connector assembly and a unitary male connector plug. The female connector includes a first portion intended for appropriate connection by soldering or the like to appropriate connection points within the circuitry in the interior of the radio housing. A second female connector portion makes a snap-in, weather tight fit within an opening provided in the radio housing and which mechanically and electrically engages the first female connector portion. A mechanical leaf switch included on the underside of the second female connector portion and which locates within a recess and the first female connector portion, when the two connector components are interfitted with one another, is effective to switch the audio circuit from the internally located loudspeaker to the remotely located speaker. This switching action as well as other appropriate control functions is effected by the male connector plug interfitting within the female connector assembly.

Moreover, the male plug includes a plurality of wiper arms set at a predetermined angle, which wiper arms make wiping engagement with and are spring biased against associated contact elements within the female connector body. The male plug is maintained in the interfitted relation with the female connector assembly by an appropriate latching or securing device, such as a turn screw or threaded knob. When the latching device is released, the spring bias on the wiper arms in the male plug causes an automatic disconnect action as well as ensuring that the connector plug is at least partly ejected from the female assembly portion. The male connector plug also includes a projection extending therefrom which cooperates with a recess provided in the radio housing to permit a camming action for ensuring proper alignment and interfitting of the male plug into the female portion.

BRIEF DESCRIPTION OF THE DRAWINGS

The features of the present invention which are believed to be novel are set forth with particularity in the appended claims. The invention itself, however, with further objects and advantages thereof, may best be understood by reference to the following description when taken in conjunction with the accompanying drawings, in which like reference numerals refer to like elements in the several figures, and in which:

DESCRIPTION OF THE PREFERRED EMBODIMENT

Figure 1:
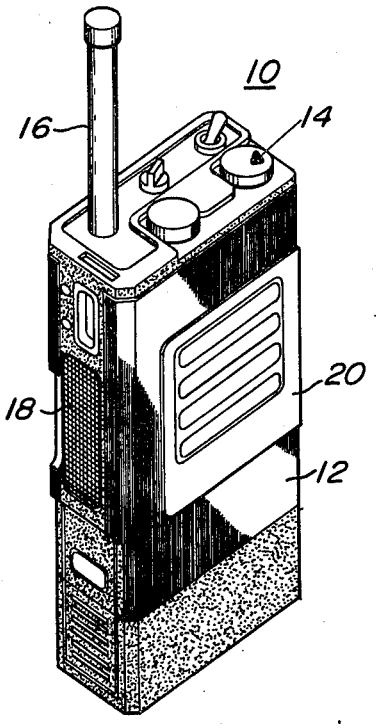
FIG. 1 is an elevational view in perspective of a portable, hand-held two-way radio communications apparatus of the type in which the present invention may be advantageously utilized.

Referring now to the drawings, a portable, hand-held, two-way radio communications unit 10 is shown in FIG. 1, which radio unit may be considered as typical of the miniaturized electrical or electronic apparatus which may advantageously utilize the present invention. The radio unit 10 includes a housing 12 for containing associated electronic circuit (not shown) suitable for transmitting and receiving functions as well as a self-contained power supply containing one or more battery cells (not shown). The housing 12 can be in the form of a simple unitary construction or, alternatively, provided as a multiple housing section which interfit each with the other.

Unit 10 further conventionally includes a plurality of manually operated controls identified generally at 14, which are accessible from the outside of housing 12 for effecting the necessary control functions, such as volume, squelch, frequency selection and on/off control. An antenna 16, usually of a telescopic rod type, may extend upwardly from the top. A push-to-talk switch actuator 18 is customarily provided on a side panel of the unit 10, substantially as shown (FIG. 1) for activating the transmitter circuitry (not shown).

The radio unit 10 is ordinarily operated from its internal power source. For transmitting, the push-to-talk switch 18 is actuated by the user while talking in close proximity to the front grille 20. The sound passes therethrough and reaches an internally positioned microphone (not shown) which converts the sound energy into electrical energy and modulates appropriate carrier generating circuitry. For receiving, messages picked up by antenna 16 are suitably demodulated and the audio amplified and reproduced in a loudspeaker positioned behind grille 20.

In those instances, however, when a remote microphone is needed or required, or if the radio unit 10 is to be operated from other than as a hand-held device, such as, for example, in a vehicular installation, certain control functions are necessary. In the first instance, internally positioned microphone and loudspeaker apparatus must be disconnected and those incorporated in the remote located unit substituted instead. Additionally, for the vehicular converter installation, external mounted antenna apparatus as well as the vehicular power source must also be interconnected through the radio unit 10.

Figure 2:
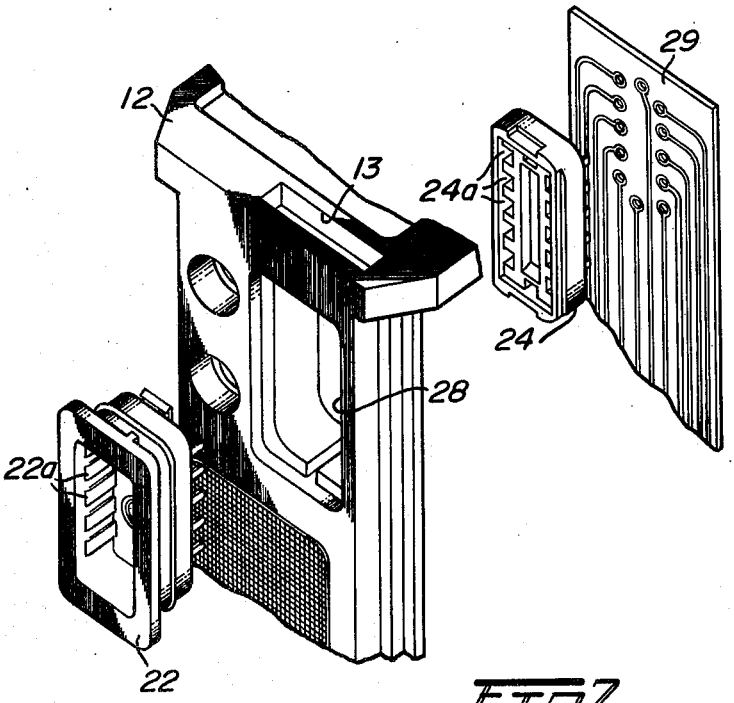
FIG. 2 is an enlarged exploded view of the female connector assembly forming a part of the present invention and illustrating the manner in which it interfits within the radio housing.

The foregoing requirements can be readily effected by an improved connector arrangement identified generally at 20, which connector arrangement has been constructed in accordance with the present invention. The connector arrangement contemplates a two-piece female connector assembly 22–24 and a male connector plug 26. As best seen in FIG. 2, the connector portion 22 interfits within a suitably shaped opening 28 in housing 12 as will be more fully described subsequently. The connector portion 24 is intended to be interconnected to associated circuitry within the interior of unit 10 such as the flex circuit identified generally at 29. The interconnection to flex circuit 29 is intended to be of a relatively permanent nature, such as by soldering or the like. For assembly, connector portion 24 simply and readily interfits with connector portion 24 by a snap fit. No additional operations, such as soldering or other wire lead connections, are necessary.

Figure 3:
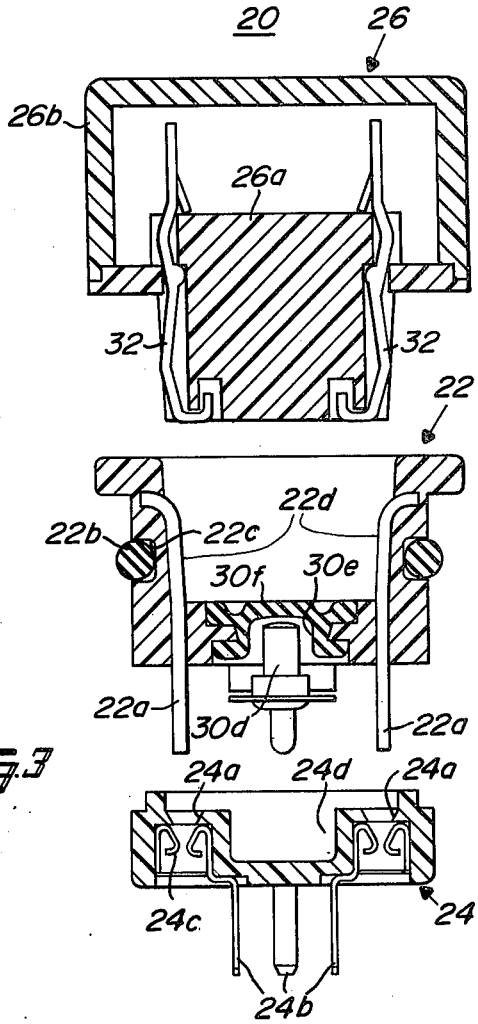
FIG. 3 is an enlarged front cross sectional view of the female connector assembly and male plug embodying the present invention.
Figure 4:
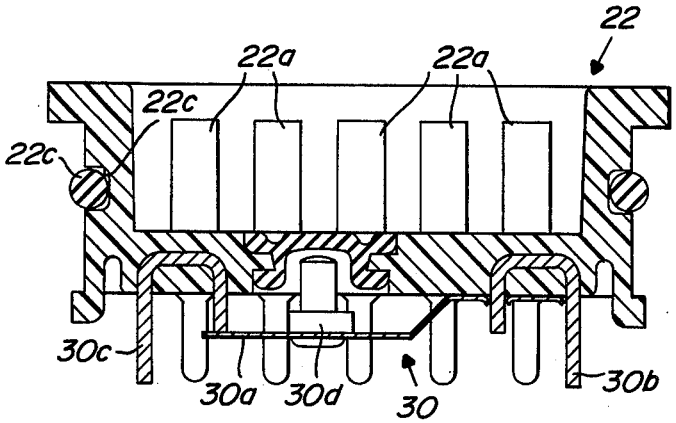
FIG. 4 is a side cross sectional view of one part of the female connector assembly of FIGS. 2 and 3.

The snap-in connection between connector portions 22 and 24, forming the female connector assembly, may be more readily appreciated by a reference to FIG. 3. As indicated, the top or main connector body 22 has an essentially hollow interior, open at the top. A plurality of flat contact members or strip elements **22*a* are arranged along each side wall (FIG. 4) and extend downwardly, through, and beyond the bottom surface of the connector body a predetermined distance. A resilient weather proofing ring or seal 22*b* fits within a groove 22*c* around the side or periphery of the connector body, as illustrated. As likewise best seen in FIG. 4, a leaf type switch contact assembly 30 is located on the underside of the bottom surface of connector 22. The spring leaf element 30***a* anchored at one end is in electrical contact with an essentially U-shaped contact terminal 30*b.* Leaf element 30*a* is spring biased, in its normal position, into electrical contact with another contact terminal 30*c.* An actuator button 30*d* is attached at a centralized location to leaf element 30*a,* which button extends upwardly into a recess 30*e* within the body of connector portion 22. A resilient cover 30*f* fits within this recess and provides a substantially watertight seal, while at the same time being sufficiently flexible to permit physical contact with the actuator button 30*d* when cover 30*f* is suitably depressed.

The terminal end portions of contact members 22*a* of connector portion 22 insert within associated rectangular openings 24*a* in the connector base 24 and make electrical contact with an associated contact terminal 24*b.* Each of the contact terminals 24*b* includes a pair of in-turned lip portions 24*c* which are spring biased against the inserted portion of the contact strip element 22*a.* The base connector 24 further includes a central recess 24*d* within which the spring leaf contact assembly 30 extends when connector portion 22 is interfitted to the associated connector portion 24.

Figure 5:
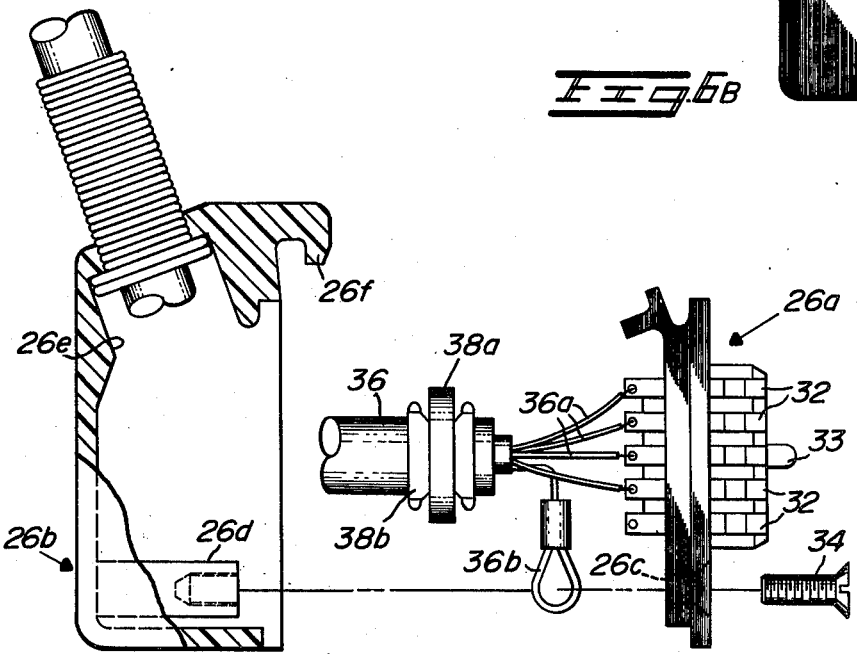
FIG. 5 is an enlarged cross sectional and exploded view of the male connector plug.

The male connector plug 26 is adapted for detachable interconnection to the two-piece female connector assembly 22–24 when the latter is assembled to, and within, radio housing 12, as previously described. As will be more readily apparent by reference to FIG. 5, connector 26 includes a base portion 26*a* in which a plurality of electrical contact spring elements 32 are captivated. Base portion 26*a* fits partially within housing 26*b* and is secured thereto by suitable fastening means, such as machine screw 34 passing through clearance passage 26*c* in base 26*a* and threadably received within an internally upstanding post 26*d* anchored in housing 26*b.*

Suitable electrical connection to the spring contacts 32 are made by the various wire leads 36*a* forming the electrical cable 36. Spring relief for cable 36 is provided first, by the flexible braid 36*b,* looped at its terminal end, and overlying post 26*d.* Additional strain relief is provided by the hinged, square-shaped restraining block 38*a* overfitting a sleeve 36*b,* which is in turn fitted onto cable 36. Restraining block 38*a* locates within an appropriately dimensioned recess 26*e* in housing 26*b,* as indicated.

As mentioned previously herein, there are instances in which it may be desired to operate the radio unit 10 by other than the self-contained, built-in controls and, further, operate from a remote location as well. For example, if the unit 10 is to be worn on the belt of a user, i.e., policemen, firemen, ranger, etc., the remote control unit (not shown) is ordinarily to be worn on the lapel of the user and he or she need merely turn his or her head and speak while actuating the remote push-to-talk switch. Accordingly, the remote unit would ordinarily include a separate antenna, similar to the antenna 16, a loudspeaker-microphone apparatus and suitable manually operated controls, such as puch-to-talk, squelch, volume, on/off and perhaps frequency selection, if applicable. The operation of such control unit will be readily apparent to those skilled in the art and further description is not deemed necessary. For a more complete description of such remote control units or apparatus, reference may be made to U.S. Pat. Nos. 3,370,236 and 3,720,484, both assigned to the same assignee as the present invention.

In any event, the antenna, mnual controls and internal microphone/loudspeaker mounted on or within the radio unit 10 must be disconnected and those included in the associated remote control unit interconnected instead. This is readily accomplished by the connector assembly 20 of the present invention, comprising the female connector assembly 22–24 and the associated male connector plug assembly 26. The necessary electrical connections are made through the cable 36 to the contacts 32 of plug 26, and from there to the contacts 22*a*–24*b* of female connector assembly 22–24, which in turn are connected to appropriate points in the circuitry positioned in the interior of radio unit 10.

In the past, similar connector apparatus required a careful alignment and interfitting of the connector apparatus utilized. This was time consuming and any misalignment could well result in damage to the connector components if they were nevertheless forced or otherwise jammed together. Moreover, additional time was required in order to pry apart and disconnect the connector components when the associated control unit was no longer required.

Figure 6A:
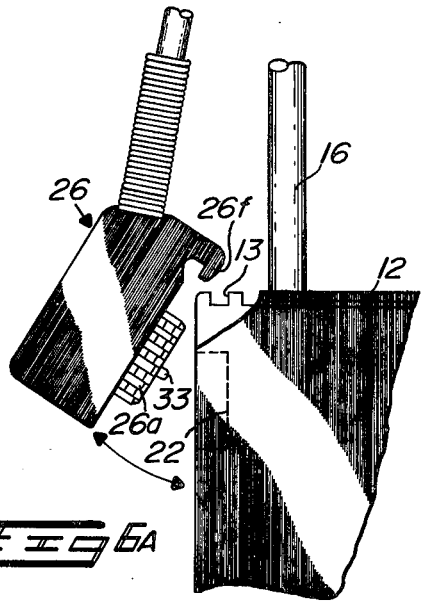
FIG. 6A is a partial front elevational view of the radio apparatus and associated male connector plug in position to interconnect thereto.
Figure 8:
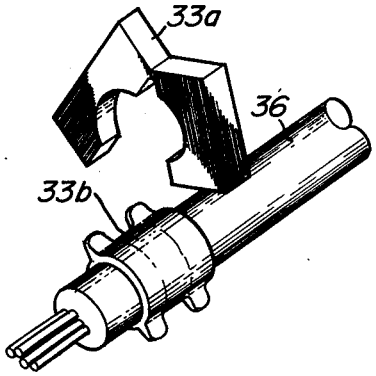
FIG. 8 is an enlarged partial view in cross section of the male connector plug showing the contact spring construction.
Figure 6B:
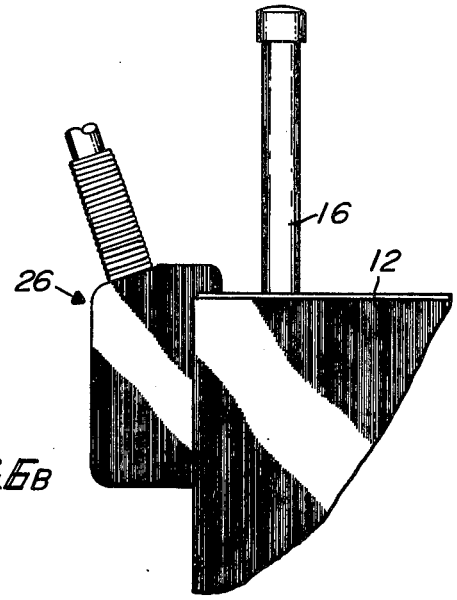
FIG. 6B is a similar partial front elevational view showing the male connector plug in its interconnected position.

In the present invention, the interfitting of the connector plug 26 into female connector portion 22 includes an automatic alignment facility and misalignment problems are effectively eliminated. Moreover, the connector assembly 20 includes an automatic disengage and partial ejection capability. As will be more readily apparent from FIGS. 6*a* and 6*b,* male connector plug 26 includes a hook-like projection 26*f* overhanging one edge portion thereof. Projection 26*f* is dimensioned to effect engagement within a recess 13 at the top corner of housing 12 and to provide a camming action whereby connector 26 may be rotated down and into engagement with the interior of connector portion 22, as shown in FIG. 6*b,* without additional operational steps being required. The plug base 26*a* is automatically aligned within the interior of connector portion 22. As the plug base 26*a* enters connector portion 22, actuator rod 33, extending outwardly a given distance therefrom, pushes against the resilient cover 32*e* and into engagement actuator button 30*d.* This in turn pushes leaf contact spring 30*a* out and away from terminal 30*c,* breaking electrical contact. This interrupts the audio circuit within the radio unit 10. At the same time, contact elements 32 engage and press firmly against contacts 22*a* in connector portion 22. Connector 26 may be maintained in the interconnected position, as shown in FIG. 6*b,* by any suitable but detachable fastening means (not shown) sufficient to secure connector 26 to housing 12 of the radio unit 10.

Figure 7:
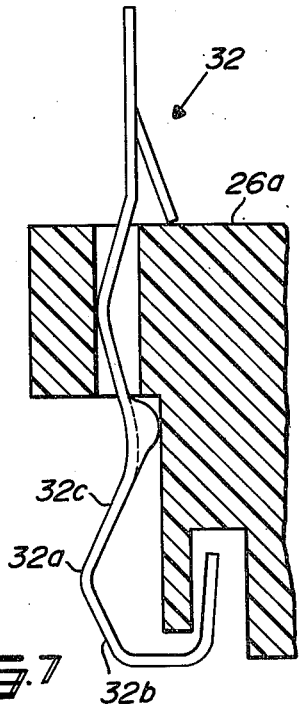
FIG. 7 is a partial enlarged view of the cable strain relief utilized in the male connector plug.

The contacts 32 in male plug 26, in their preferred form, include a forward portion having a side or laterally projecting apex 32*a* (FIG. 7), with downwardly sloping surfaces 32*b* and 32*c* on respective sides thereof. Upon insertion into connector portion 22, the frontmost surface 32*b* makes a wiping engagement with an associated one of contact members 22*a.* This provides a self-cleaning action and ensures the elimination of any contamination that may otherwise result in poor electrical response.

In addition, apex 32*a* is depressed inwardly, upon plug 26 being inserted into connector portion 22, and provides a set spring bias in the lateral direction. Not only does this ensure good electrical continuity between contact element 22*a* and 32, but it also creates an automatic disconnect and eject capability. When the fastening means securing connector plug 26 to housing 12 is released, the angle of the wiping surface 32*b* on contacts 32, in combination with the spring bias being exerted by apex 32*a* on each of the contacts 32, is sufficient to force connector base 26*a* upwardly and, at least partially, outwardly from the interior of female connector portion 22, thereby electrically as well as physically disconnecting most, if not all, of the contact wiper arms 32 from their associated contact elements 22*a*. That is, the wiping surface 32*b* of contacts 32 is at some given angle with respect to the vertical (best seen in FIG. 7). Moreover, though not necessary, the surface 22*d* of contacts 22*a* may also be at some slight angle with respect to the vertical, i.e., slightly tapered. In any event, when male plug 26 is interfitted with female connector portion 22, contact elements 32 are placed under spring tension. Upon release, due to the inclined faces of surfaces 32*b*, as well as surfaces 22*d*, where suitably tapered, there will be two components of force, one horizontal and one vertical. The latter then forces male connector portion 26*a* upwardly and outwardly about the pivot point formed by projection 26*f* and housing slot 13 (FIG. 6A). This completely eliminates the normal twist and pull operation otherwise required in prior art structures.

While a particular embodiment of the present invention has been shown and described herein, it will be obvious to those skilled in the art that various modifications and alternative constructions may be made without departing from the invention in its broader aspects. Accordingly, the aim in the appended claims is to cover all such modifications and alternative constructions as may fall within the true spirit and scope of the invention.

What is claimed is:

1. An improved subminiature electrical connector arrangement for use with associated electrical apparatus with internally positioned components, said connector arrangement including in combination:

a housing having an opening and a recess spaced therefrom;

a female connector assembly having a first portion thereof for positioning internally of said housing and adapted for interconnection to components of the apparatus, and a second connector portion for making a snap-in, water-tight fit within said opening in said housing and mechanically and electrically engaging said first connector portion;

a male connector plug for detachably interfitting with said second connector portion of said female assembly; and means for securing said male portion in the interfitted relation within said female portion, said male connector including means for automatic alignment of said plug when interfitting with said female connector portion, said means including a projection extending therefrom for effecting a camming action with respect to said housing recess together with contact elements being positioned about the periphery of said male connector plug and having forward tapered portions, said male connector further including means for automatic disengagement with and at least partial ejection from said female connector portion upon release of said securing means.

2. An improved subminiature electrical connector arrangement in accordance with claim 1 wherein said second connector portion includes a groove extending around the periphery thereof and in which a resilient weather seal may be positioned and compressed between said groove and the walls of said opening when said second connector portion is interfitted therein.

3. An improved subminiature electrical connector arrangement in accordance with claim 1 wherein said first female connector portion includes a centrally located recess and said second female connector portion includes a leaf type switch contact assembly positioned on the underside thereof and which locates within said recess in said first connector portion when said two connector portions are interfitted each with the other, and wherein said male connector plug includes a projection extending outwardly therefrom for actuating said switch contact assembly upon being inserted within said second connector portion.

4. An improved subminiature electrical connector arrangement in accordance with claim 3 wherein said second female connector portion includes a centrally located recess within the interior bottom surface and covered by a resilient weather-tight seal, and wherein said leaf switch contact includes an actuator button attached thereto and extending upwardly within said recess and which may be actuated by depressing said weather-tight seal cover.

5. An improved subminiature electrical connector arrangement in accordance with claim 1 wherein said automatic disengagement and ejection means for said male connector plug includes a plurality of spring contact elements having sidewardly extending V-shaped projections which are deflected inwardly upon insertion of said plug within said associated female connector portion, and which forces said connector plug out of engagement therewith when said securing means is released.

6. An improved subminiature electrical connector arrangement in accordance with claim 1 wherein said projection effecting said camming action comprises a hook-like member overhanging one edge of said connector plug and which inserts into and pivots within said recess of said housing.

7. An improved subminiature electrical connector arrangement in accordance with claim 1 wherein said second female connector portion includes a plurality of contact members positioned along side walls therein and extending a predetermined distance through and beyond the bottom surface thereof, and wherein said first female connector portion includes a plurality of contact terminals for receiving a portion of said contact members of said second connector portion.

8. An improved subminiature electrical connector arrangement in accordance with claim 7 wherein said contact terminals of said first connector portion includes in-turned lip portions for engaging and captivating said contact members of said second female connector portion when inserted therein.

* * * * *